US006025681A

United States Patent [19]

Yu et al.

[11] Patent Number: 6,025,681

[45] Date of Patent: Feb. 15, 2000

[54] DIELECTRIC SUPPORTED RADIO-FREQUENCY CAVITIES

[75] Inventors: David U. L. Yu, Rancho Palos Verdes; Terry G. Lee, Cupertino, both of Calif.

[73] Assignee: Duly Research Inc., Rancho Palos Verdes, Calif.

[21] Appl. No.: 09/017,138

[22] Filed: Feb. 2, 1998

Related U.S. Application Data

[60] Provisional application No. 60/036,907, Feb. 5, 1997.

[51] Int. Cl.[7] ..... H05H 9/00; H05H 9/02

[52] U.S. Cl. ..... 315/500; 315/505; 315/506

[58] Field of Search ..... 315/500, 505, 315/506, 5.39, 5.41, 5.42; 313/62, 359.1, 360.1; 250/396 R

[56] References Cited

U.S. PATENT DOCUMENTS

| | | | |
|---|---|---|---|
| 4,181,894 | 1/1980 | Pottier | 315/500 |
| 4,350,921 | 9/1982 | Liska et al. | 313/360.1 |
| 4,733,132 | 3/1988 | Miyata et al. | 315/5.41 |
| 4,906,896 | 3/1990 | Swenson | 315/5.41 |
| 5,049,753 | 9/1991 | Flesner | 250/396 R |
| 5,523,659 | 6/1996 | Swenson | 315/506 |

*Primary Examiner*—Edward P. Westin
*Assistant Examiner*—Nikita Wells
*Attorney, Agent, or Firm*—Irving Keschner

[57] ABSTRACT

A device which improves the electrical and thermomechanical performance of an RF cavity, for example, in a disk-loaded accelerating structure. A washer made of polycrystalline diamond is brazed in the middle to a copper disk washer and at the outer edge to the plane wave transformer tank wall, thus dissipating heat from the copper disk to the outer tank wall while at the same time providing strong mechanical support to the metal disk. The washer structure eliminates the longitudinal connecting rods and cooling channels used in the currently available cavities, and as a result minimizes problems such as shunt impedance degradation and field distortion in the plane wave transformer, and mechanical deflection and uneven cooling of the disk assembly.

4 Claims, 3 Drawing Sheets

DIELECTRIC SUPPORTED RADIO-FREQUENCY CAVITIES

RELATED APPLICATIONS

This application is based on U.S. Provisional Application No. 60/036,907 filed Feb. 5, 1997.

GOVERNMENTAL RIGHTS IN INVENTION

This invention was made with Governmental support under Small Business Innovation Research (SBIR) Contract No. DE-FG03-96 ER 82156 awarded by the Department of Energy to DULY Research Inc. The Government has certain rights in the invention.

BACKGROUND OF THE INVENTION

1. Field of the Invention

The present invention is related to radio-frequency (RF) structures, such as klystron or accelerator cavities wherein a special dielectric is used to support metallic elements inside the structure whereby superior electrical and thermomechanical performances are obtained.

2. Description of Prior Art

Present-day radio frequency (RF) cavities such as those in linear accelerators for charged particle beams typically comprise a series of metallic disks with a beam hole at the center. The metallic disks are separated by a distance equal or close to an integral fraction (1/N, where N is an integer) of the wave length of the pulsed RF power which energizes the beam. The RF frequency ranges widely from hundreds of megahertz to a tens of gigahertz and higher. In common practice, the inter-disk distance is maintained by a metallic spacer between two adjacent disks as in the case of a traveling wave (TW) structure, or by two or more metallic rods as in the case of a "plane wave transformer (PWT)" structure. A conventional PWT accelerating structure 10 is shown in FIG. 2. In this structure, the disks 12, having irises 13 formed therein, are connected by four rods 14 which also provide circulating coolant to the interior of the disks 12 to take away the heat generated by the coupling of the iris-loaded metallic disks to the RF field. The supporting rods 14 are connected to end flanges (not shown). The accelerating structure, or disk assembly, 10, is placed inside a cylindrical tank 16 which includes an input port for the incoming RF power. A unique feature of the PWT structure is that there is a very strong and efficient RF coupling between the electromagnetic field inside the outer tank 16 and all the accelerating cells between the disks 12. Another advantage of the PWT is that as a result of the strong coupling, the mechanical tolerance of the disks assembly is quite loose, thus making fabrication easier and less costly. On the other hand, there are several disadvantages of the PWT design shown in FIG. 2. The metallic rods 14 connecting the disks 12 distort the accelerating electromagnetic field, thus degrading the beam quality. The coupling of the magnetic field into metallic rods increases loss and reduces the shunt impedance and the quality factor of the accelerating cavity, thus lowering the efficiency. The method of heat removal in the metal disk by circulating coolant in its interior requires complicated design and expensive brazing of two halves of each disk. Finally, since the rods 14 are only supported at the two end flanges, excessive deflection at the center of a long disk assembly can only be avoided by increasing the diameter or wall thickness of the connecting rods, which would compound the electrical problems.

SUMMARY OF PRESENT INVENTION

The present invention provides a device which improves the electrical and thermomechanical performance of an RF cavity, for example, in a disk-loaded PWT accelerating structure.

A washer (typically less than one millimeter thick) made of polycrystalline diamond, or a material having similar thermal, dielectric and mechanical properties, is brazed in the middle to a copper disk washer, and at the outer edge to the PWT tank wall, thus efficiently dissipating heat from the copper disk to the tank, while providing strong mechanical support to the metal disk. The washer structure eliminates the longitudinal connecting rods and cooling channels of the conventional design, and as a result minimizes such problems as shunt impedance degradation and field distortion in the PWT, and mechanical deflection and uneven cooling of the disk assembly.

BRIEF DESCRIPTION OF THE DRAWINGS

For a better understanding of the present invention as well as other objects and further features thereof, reference is made to the following description which is to be read in conjunction with the accompanying drawings wherein.

DESCRIPTION OF THE INVENTION

The present invention provides apparatus for holding individually and collectively a set of metallic partitions, or disks to form a plurality of cavities in an RF structure. A preferred embodiment of this invention is in an RF linear accelerator for a charged particle beam (such as electrons, protons, or ions). In the case of a cylindrical (rectangular) accelerating structure, each of these partitions is a circular (rectangular) flat disk with a circular (rectangular) hole at its center through which the beam passes. The disks are held in place in a prescribed manner by circular (rectangular) slabs made of special high strength dielectric material characterized by high thermal conductivity, low electrical conductivity, high threshold of electrical breakdown voltage, low dielectric constant and low dielectric loss. An example of such material is polycrystalline diamond, which is commercially available. Typical chemical, electrical and thermomechanical properties of the polycrystalline diamond are shown below:

Thermal conductivity >1300 w/m-°K

Electrical resistivity $>10^{11}$ ohm-cm

Thermal expansion coef. Approx. $2\times10^{-6}$ °C., 25–200° C.

Dielectric constant 5.7

Loss tangent <0.0005 @ 15 GHz

Dielectric strength 100–300 MV/m

Chemical behavior Insert to acids, alkalis and solvents

Oxidation behavior Resistant to 700° C.

The dielectric material (polycrystalline diamond) can be precision cut with a laser. A commercially available form of polycrystalline diamond is Diamonex®, manufactures by Diamonex Inc., Allentown, Pa.

Figure 1:
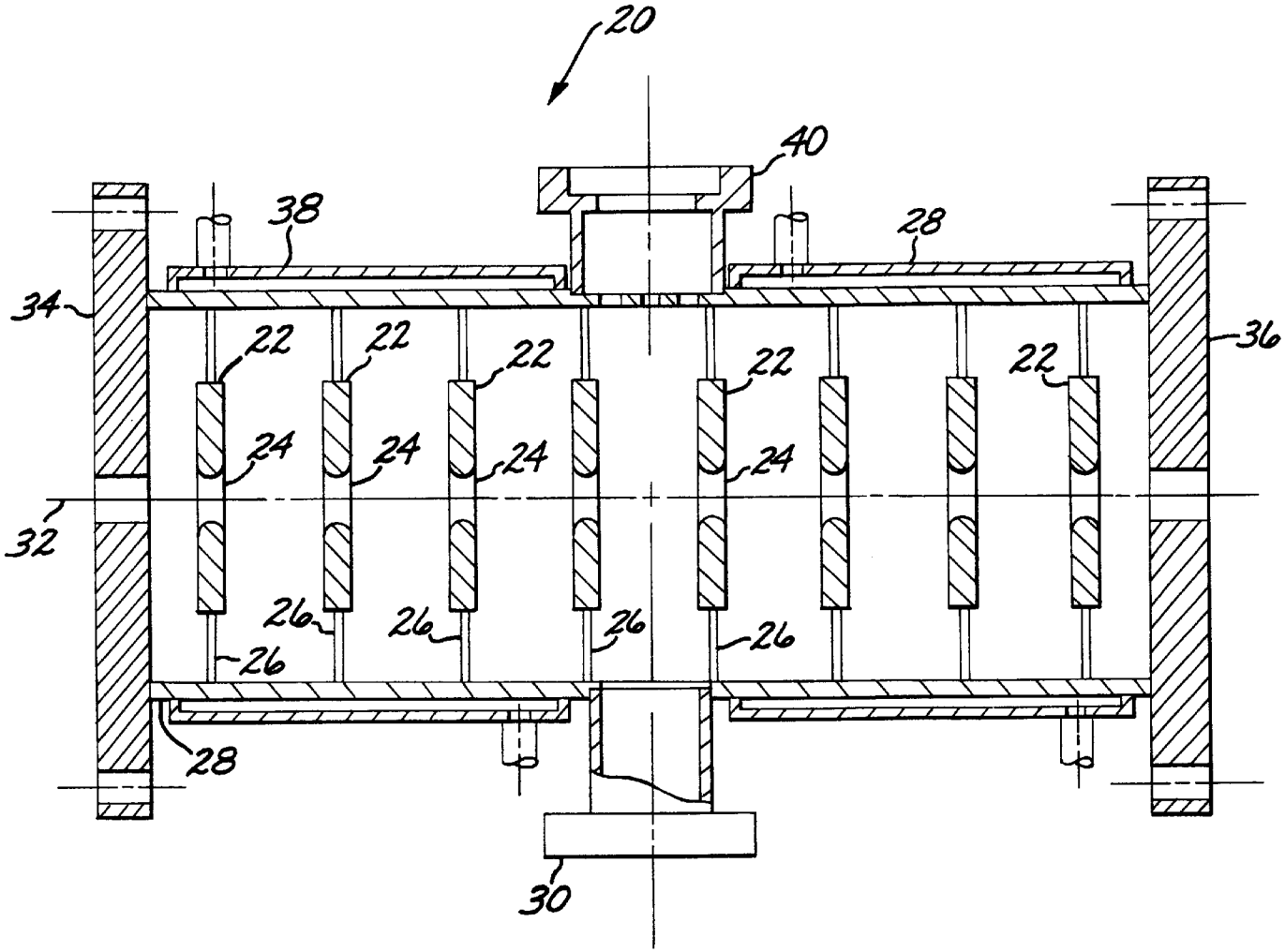
FIG. 1 is schematic diagram of the present invention as incorporated in a plane wave transformer accelerating structure.
Figure 3:
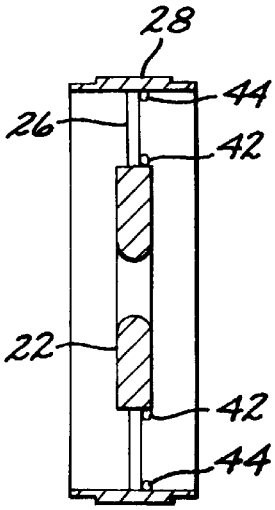
FIG. 3 is a diagram showing the brazing joints of the dielectric support to the metallic disk and to the outer tank wall.

FIG. 1 shows a preferred embodiment of the invention as utilized in a plane wave transformer photoelectron accelerator (PWTPA) 20. In the PWTPA 20, a pulsed laser beam hitting a cathode produces bunches of photoelectrons which are accelerated synchronously by a standing-wave Rf field in phase with the advancing electrons along the axis 32 of the PWTPA cavity 20. A cavity is formed in the space between two adjacent metal (e.g. copper) disks 22. A beam hole 24 is provided at the center of each metal disk 22. In accordance with the teachings of the present invention, each disk 22 is supported by a thin, concentric, dielectric washer, or slab, 26 (typically less than one millimeter thick) with the inner edge of the washer brazed to the outer edge of the metal disk 22. The dielectric washer 26 provides the only necessary support for each metal disk 22. Each dielectric washer 26 is preferably made of material similar to that whose properties are shown in the above table. The outer edge of the dielectric washer is brazed at a prescribed axial location to the wall of a metallic (e.g copper plated steel) housing tank 28 of the PWTPA 20 thus securing the required position of each metal disk 22. RF power from an external source (e.g. a klystron) is coupled to the PWTPA through an inlet port 30. A plane-wave like, TEM mode of electromagnetic wave is established in the annular region between the inner tank and the disk assembly. Housing tank 28 is coupled to the end flanges 34 and 36 and a water jacket 38 is provided to cool the PWTPA 20. A vacuum port 40 is provided to maintain a vacuum within PWTPA 20. A TM mode of electromagnetic wave which provides the accelerating gradient is established along the axis 32 of the cavities. Since there is no cavity wall expect the faces of the metal disks 22, the fields in the tank 28 and those in the cavities are strongly coupled. The edges of the dielectric washer 26 are metalized. The locations of the brazing joints of the dielectric washer 26 to the metal disks 22 and the housing tank 28, illustrated by reference numerals 42 and 44, respectively, are shown in FIG. 3.

In case the thermal expansion coefficient of the dielectric washer 26 (as in polycrystalline diamond) is lower than that of the metal disk 22 (such as copper), the disk may be made of base material, such as molybdenum, with a thermal expansion coefficient close to that of the dielectric, and coated with metal (e.g. copper). This minimizes thermal stress and avoids tearing of the brazing joints during thermal transients. Alternatively, the dielectric washer 26 can first be brazed to thin concentric copper cylinders and subsequently to a thick inner copper disk and the outer wall.

Figure 4:
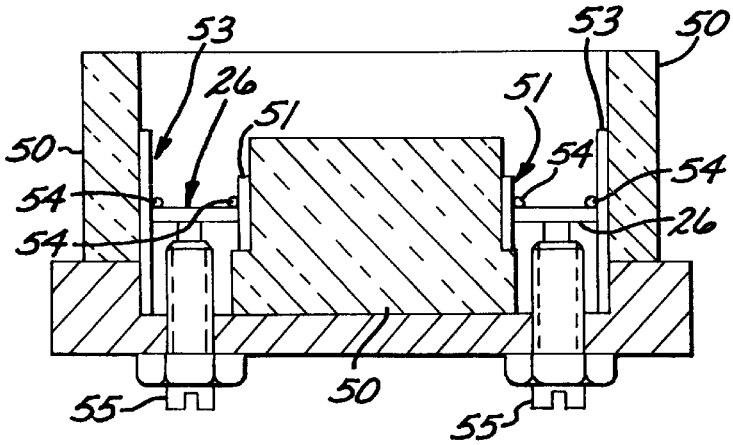
FIG. 4 is a diagram showing a tool to be used for precision alignment during brazing.

A carbon fixture 50 in the shape shown in FIG. 4 may be used to align the dielectric washer 26 with the metal disk 22 and the outer tank wall 28. Fixture 50 is used to hold the work during brazing of a dielectric washer 26 to thin concentric copper cylinders 51 and 53. Items 54 are braze rings. Alignment screws 55 are provided for adjustment purposes. Since carbon has a lower thermal coefficient of expansion than copper, pressure is maintained between the dielectric washer and cooper during the braze cycle. After completion of the brazing of dielectric washer 26 to thin copper cylinders 51 and 53, fixture 50 is removed. The separate tank sections with dielectric washers and a metal disk already in place are then brazed together to form an integral cylindrical tank.

There are several advantages of supporting the metal disks with a dielectric washer in the manner described above.

In the present invention as illustrated in FIG. 1, the heat generated by RF power impinging on the surfaces of metal disks 22 is removed by conduction through the dielectric washer 26 to the outer tank 28. The high thermal conductivity of the dielectric (e.g. polycrystalline diamond) ensures efficient removal of the heat without the necessity of any active cooling of the disks. There is no need to have any coolant channels inside the metal disks, thus simplifying the design.

Further, the direct dissipation of heat is achieved by conduction from the metal disks 22 through the dielectric washer 26 to the outer tank wall 28. The temperature of the outer wall 28 can be controlled by a heater or a constant temperature water bath or jacket 38. This in turn controls the temperature of the irises 24 at the metal disks 22 and makes frequency tuning an easy task.

Figure 2:
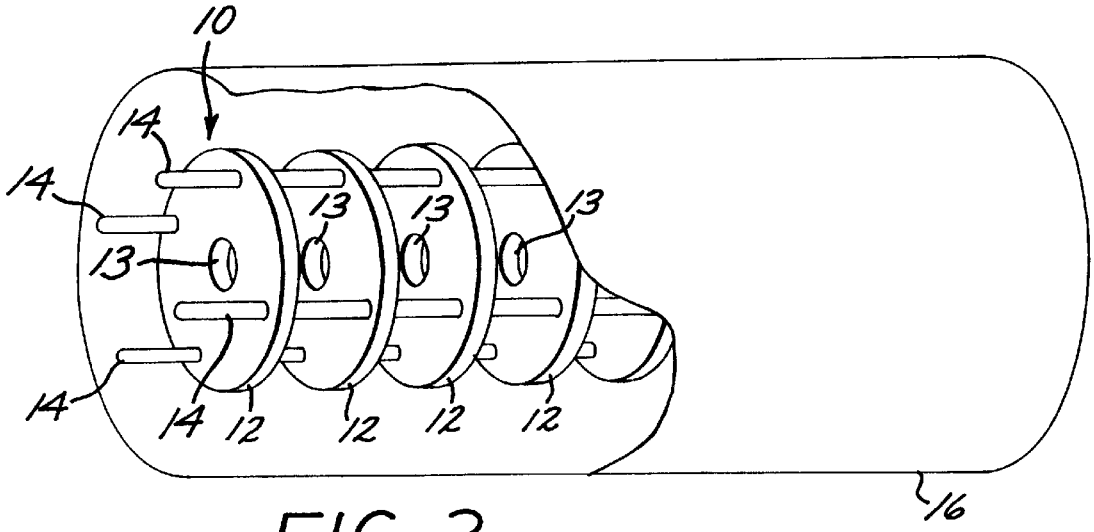
FIG. 2 PRIOR ART
FIG. 2 is a schematic diagram of a prior art plane wave transformer accelerating structure.

In addition, there is no metal rods or cups connecting the metal disks (as in the conventional PWT design shown in FIG. 2). The absence of such perturbing metal elements in the PWTPA of the present invention alleviates distortion of electromagnetic field symmetry and reduces loss due to RF interaction with such metal elements. Thus, the embodiment of the present invention in the PWTPA 20 results in a higher quality factor Q and a higher shunt impedance R.

Further, each metal disk 22 is mechanically supported by a dielectric washer 26 with high compressive strength. Compared with the conventional PWT design in which the disks are connected by a set of longitudinal rods which are supported by end flanges, the embodiment of the present invention avoids mechanical deflection, or "sagging" of the disk assembly, ensuring improved beam dynamics.

Finally, each metal disk 22 is a solid piece. There is no need to braze two halves of each disk in order to create cooling channels in the disk interior. This reduces the cost manufacturing.

Figure 5A:
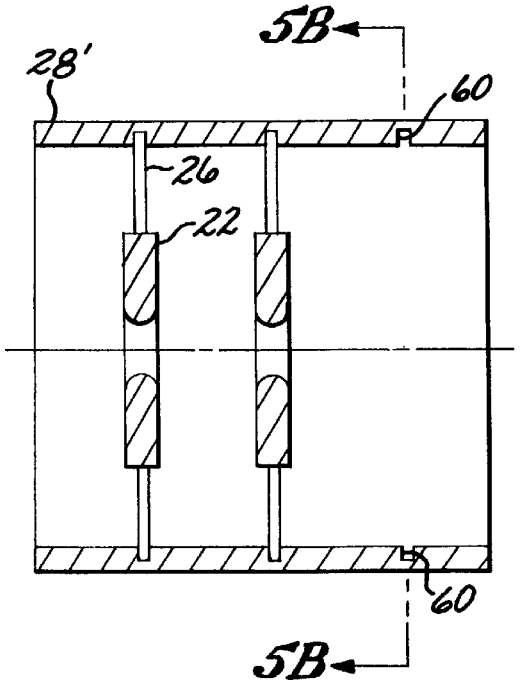
FIGS. 5A and 5B show an alternate method of connecting the dielectric support to the outer tank wall.
Figure 5B:
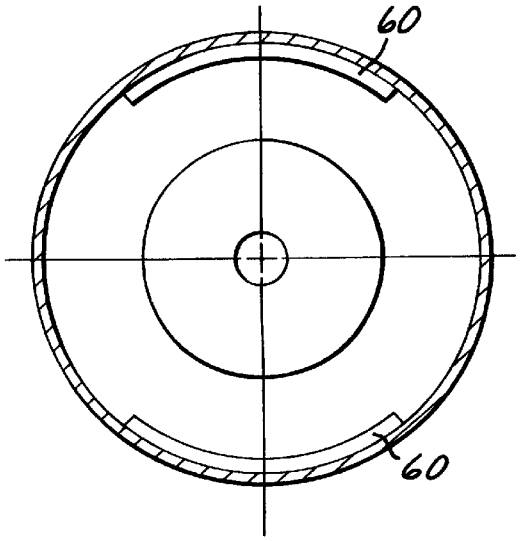

An alternative method of attaching a brazed metal disk/dielectric washer to the outer tank wall 28' is shown in FIGS. 5A and 5B. In this method, a slip fit instead of brazing joint is used at the dielectric washer/tank wall junction. A series of circumferential female retainers 60 are first machined into the inside of the tank wall 28'. Each set of retainers 60, at given axial location, consists of two narrow grooves, each spanning an arc of 90° around the tank wall circumference, and spaced 180° apart from the other. The grooves 60 are precisely spaced apart on the inner tank wall along the axial direction to correspond to the required spacing between the metal disks of the PWTPA 20. The outer edge of the dielectric washer 26 is machined into two shallow fins 29 (see FIG. 6B), each spanning an arc of 90° around the outer circumference of the dielectric washer and spaced 180° apart from the other. The depth of each fin on the dielectric washer 26 is the same as the depth of the groove 60 on the wall of tank 28'. The thickness of each fin is same as the width of groove 60.

A metal disk is brazed to the center of a dielectric washer as described earlier. To insert a dielectric washer (with a metal disk already brazed at its center) into the retaining grooves 60 on the wall 28' the fins on the dielectric washer 26 are first aligned at exactly the same axial location of grooves 60 on the tank wall, but 90° apart circumferentially from the grooves. The dielectric washer/metal disk is then rotated by 90° to fit the fins into grooves 60. Sufficient radial, axial and circumferential clearances are provided so that the fins on the dielectric washer 26 can be tightly fit into grooves 60 on the tank wall without interfering with the insertion process. This alternate method of attaching the washer/disk to the outer tank 28' has the advantage of ease of insertion and replacement of the disk assembly but at the expense of somewhat degraded electrical and thermal performance of the PWTPA 20. The retaining grooves 60 on the outer wall of tank 28' would induce some loss. In addition, the slip fit between the dielectric washer 26 and the retaining grooves 60 would increase the thermal resistance at the joint, particularly during down cycles of thermal transients. During up cycles of thermal transients, however, the temperature of the dielectric washer 26 is higher than that of tank wall 28'. A slight interference fit may result, thus mitigating the reduction of thermal resistance at the slip-fit junctions.

Figure 6A:
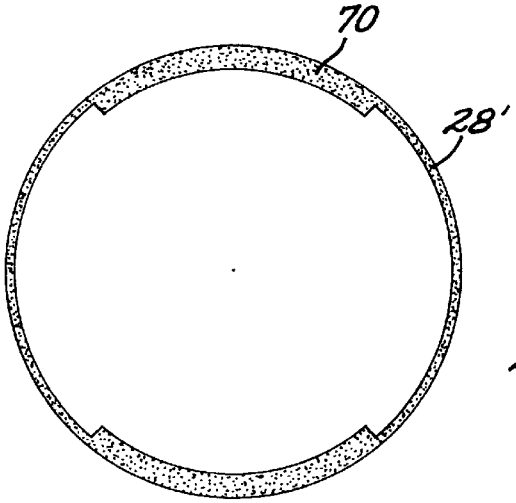
FIGS. 6A and 6B illustrate the dielectric-disk assembly before insertion into the tank shown in FIG. 5A.
Figure 6B:
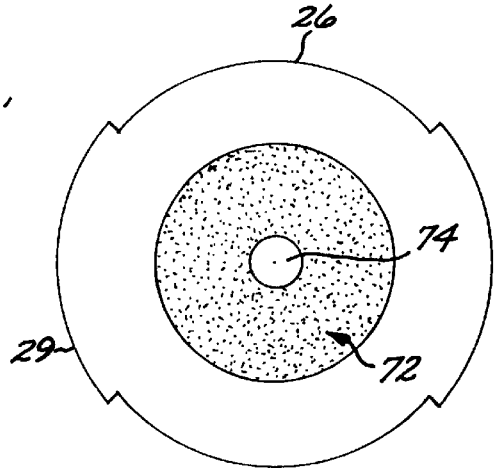

FIGS. 6A and 6B shows the dielectric-disk assembly before insertion into the tank 28'. Shown is copper retainer 70, tank wall 28', fins 29, dielectric disk, or washers 26, copper disk 72 and iris, or beam hole, 74.

While the invention has been described with a reference to its preferred embodiments, it will be understood by those skilled in the art that various changes may be made and equivalents may be substituted for elements thereof without departing from the true spirit and scope of the invention. In addition, modifications may be made to adapt a particular situation or material to the teachings of the invention without departing from its essential teachings.

What is claimed is:

1. An RF cavity for accelerating charged particles introduced therein comprising:

a housing structure having an inner surface and a longitudinal axis;

a plurality of metallic members positioned within said structure and space along said longitudinal axis, each metallic member having inner and outer edges; and supporting members for supporting each metallic member within said structure, said supporting members being fabricated from a high strength dielectric material characterized by high thermal conductivity, low electrical conductivity, high threshold of electrical breakdown voltage, low dielectric constant and low dielectric loss, wherein said dielectric material is made of polycrystalline diamond.

2. The RF cavity of claim 1 wherein each metallic member comprises a disk having a hole formed at the center thereof.

3. The RF cavity of claim 1 wherein each supporting member has inner and outer edges, the inner edge thereof being connected to the outer edge of an adjacent metallic member.

4. The RF cavity of claim 3 wherein the outer edge of each of said supporting members is connected to the inner surface of said housing structure.

* * * * *